US006347628B1

(12) United States Patent
Maison

(10) Patent No.: US 6,347,628 B1
(45) Date of Patent: Feb. 19, 2002

(54) MODULAR HYPERBARIC CHAMBER

(76) Inventor: Jack Robert Maison, 3307 Hunters Sound, San Antonio, TX (US) 78230

( * ) Notice: Subject to any disclaimer, the term of this patent is extended or adjusted under 35 U.S.C. 154(b) by 0 days.

(21) Appl. No.: 09/379,178

(22) Filed: Aug. 23, 1999

Related U.S. Application Data

(60) Provisional application No. 60/097,884, filed on Aug. 25, 1998.

(51) Int. Cl.[7] ..... A61G 10/00

(52) U.S. Cl. ..... 128/202.12; 128/205.26; 128/201.27; 600/21

(58) Field of Search ..... 128/202.12, 205.26, 128/201.27; 600/21; 601/41, 44; 52/239, 82; 405/8, 193, 192, 189, 185; 220/581, 582, 4.17, 4.16

(56) References Cited

U.S. PATENT DOCUMENTS 2,402,253 A * 6/1946 Macleod ..... 220/81

5,327,904 A * 7/1994 Hannum ..... 128/205.26

* cited by examiner

*Primary Examiner*—John G. Weiss
*Assistant Examiner*—Mital Patel
(74) *Attorney, Agent, or Firm*—Kilpatrick Stockton LLP

(57) ABSTRACT

A modular hyperbaric chamber for treatment of at least one patient that includes at least one spacer module having a first flange and a second flange. The spacer module may be formed from a plurality of sections, with each section including opposing lip portions to form air-tight junctions. A first half cylinder module includes a first peripheral contact edge for releasable sealed connection to the first flange of the spacer module. Similarly, a second half cylinder module includes a second peripheral contact edge, for releasable sealed connection to the second flange of the spacer module. An access door, formed in at least one of the half cylinder modules provides access to the interior of the chamber. The overall size of a hyperbaric chamber may be conveniently increased by inserting additional spacer modules between the half cylinder modules.

17 Claims, 4 Drawing Sheets

MODULAR HYPERBARIC CHAMBER

RELATED PATENT APPLICATIONS

This patent application claims priority to United States Provisional Application No. 60/097,884 filed Aug. 25, 1998 and entitled MODULAR HYPERBARIC CHAMBER; said application in its entirety is hereby expressly incorporated by reference into the present application.

DESCRIPTION

1. Technical Field

The present invention relates to medical treatment involving pressurized oxygen, and more specifically to hyperbaric pressure chambers for patient accommodation. In particular, the invention provides chambers of modular construction, capable of size adjustment to meet specified requirements. This allows treatment facilities some flexibility to respond to fluctuating demand, both increasing and decreasing, for hyperbaric oxygen treatment.

2. Background Art

Traditional hyperbaric oxygen treatment (HBO) requires a patient to breathe 100% oxygen while at a pressure greater than ambient, i.e. >1 atmosphere absolute (ATA). HBO is an established technology to help resolve certain chronic, recalcitrant, expensive, or otherwise challenging medical problems. Treatment can be carried out in either a monoplace or multiplace chamber. The former accommodates a single patient and the entire chamber is pressurized with 100% oxygen which the patient breathes directly. A multiplace chamber may hold two or more patients, observers, and support personnel. It is pressurized with compressed air and the patients breathe 100% oxygen via a mask, head tent, or endotracheal tube. According to the Undersea Hyperbaric Medical Society, breathing 100% oxygen at 1 ATA of pressure or exposing isolated parts of the body to 100% oxygen does not constitute HBO therapy; the patient must inhale the oxygen in a pressurized chamber. Current research indicates that pressurization should be to 1.4 ATA, or higher, for HBO to be most effective. The elevated pressure promotes super saturation of oxygen in blood plasma and tissue fluids. As a result, the body utilizes oxygen more efficiently and promotes healing functions.

Monoplace or single patient hyperbaric chambers are commonly fabricated from a transparent acrylic plastic tube with machined metal end plates or caps. The patient usually lies inside the confined space of the acrylic tubular compartment and breathes 100% oxygen for the duration of the treatment. Monoplace chambers are now available in different diameters for enhanced patient comfort. Other design variations on the traditional monoplace concept include chambers made of welded stainless steel with a medical attendant pod to provide "hands-on" care during treatment and very large acrylic tubes for treatment of two patients simultaneously. As an alternative to fabrication of monoplace chambers from relatively rigid materials, a variety of inflatable chambers provide individuals with on-site treatment for such situations as rescue operations and severe oxygen deprivation. As an example, inflatable HBO chambers constructed from flexible fabrics are carried by divers as a precaution against the bends which is caused by a too rapid ascent from deep diving activities.

One advantage of monoplace chambers is ease of installation, since they are relatively small and usually designed for maneuverability. In clinics or hospitals they conveniently use existing services, with minimal need for facility services and utilities such as electrical, oxygen, etc. Other benefits include ease of use, since controls are few, relative portability, as they are typically mounted on wheels, and low cost compared to larger multiplace hyperbaric systems. Representative disadvantages are: no "hands on" care by medical providers, confined space for the patient, increased fire risk due to the large amount of 100% oxygen in the chamber, a limited service life of the acrylic tube, and high staff to patient ratio.

Large multiplace hyperbaric chambers are fabricated of welded steel and commonly configured as a horizontal, generally cigar-shaped cylinder of varying lengths and diameters. Many have a rectangular entry ways for patient access. Ambulatory patients enter the chamber and sit in a wheel chair or on a provided seat. Non-ambulatory patients normally lie on stretchers or other types of litters during treatment sessions. The presence of multiple patients normally requires trained medical personnel who assist the patients in the use of the oxygen equipment and provide "front line" medical response if needed during treatment. Advantages of the multiplace hyperbaric chamber include: improved staff to patient ratio which reduces costs, the ability to provide "hands on" care, improved direct observation of patient status, and reduced fire risk. Regarding conventional multiplace systems, disadvantages include: higher initial procurement and installation costs, larger personnel pool, greater complexity in operation and chambers that are permanently located and not easily transported. Because of the size and weight of these large metallic structures, and, due to being constructed off-site, they usually require major building modifications for ground floor or basement installation. Still further, it has come to be appreciated that it is a commonly held belief throughout the HBO field that a sustained patient treatment load of at least eight patients per day is required to justify the installation and operation of a multiplace hyperbaric facility. Obviously, fewer patients are required to justify monoplace chambers.

Small treatment facilities with restricted funding would benefit from being provided flexibility in treatment configurations. As treatment activity increases beyond monoplace capabilities, however, a small medical facility traditionally had to acquire the funding and space needed to install currently available, large multiplace chambers. Acquisition of funds and space may present an insurmountable obstacle which could prevent a small facility from responding to an increasing volume of patients. This situation is undesirable for both patients and treatment providers who may procure additional monoplace chambers, unable to benefit from the added efficiencies and profit associated with the operation of multiplace units.

Clearly, a need exists for a hyperbaric treatment compartment that is capable of expansion to provide additional internal space without marked increase in the space occupied by the unit as a whole. Because of the wide disparity in characteristics and suitabilities between monoplace and multiplace hyperbaric units, the desirability of intermediate options has become clear. Further yet, the best of both configurations could be reaped from a variably adjustable system having possible configurations across a range including monoplace, multiplace and gradations therebetween. In this way, a very attractive feature of enabling the increase of treatment space by reconfiguring an existing hyperbaric unit would be provided in order to accommodate a surge of patients or to respond to a steady increase or decrease in demand for the treatment.

In view of the above described deficiencies associated with the use of conventionally designed hyperbaric oxygen chambers, the present invention has been developed to alleviate these drawbacks and provide further benefits to the user. These enhancements and benefits are described in greater detail hereinbelow with respect to several alternative embodiments of the present invention.

SUMMARY OF THE INVENTION

In the disclosed embodiment, the present invention alleviates the drawbacks described above with respect to size and cost limitations of current monoplace and multiplace hyperbaric chambers. The incorporation of several additionally beneficial features, according to the present invention, allows a medical facility to install a size-adjustable multiplace HBO chamber that corresponds to the needs of an existing number of patients. This provides a flexible approach to the management of patient care that was not previously known.

Description of multiplace hyperbaric oxygen chambers, according to the present invention, requires reference to their modular construction, relative ease of assembly and disassembly, portability and installation without significant building modification to provide the space they occupy. The feature of modular construction is particularly important for selecting the combination of parts to satisfy selected dimensions based upon the number of patients to be treated. A minimum number of parts forms what may be referred to as a mini-chamber, accommodating maybe two or three patients. Adding modules results in expanding the size of the treatment chamber until it is comparable in dimensions to traditional multiplace chambers. Application of the term "mini-multi" to chambers constructed according to the present invention, indicates the flexibility of the modular concept. Modules include flat or curved panels. The panels may also be in sectional pieces to allow freedom of design, efficient space utilization, and optimum pressurization inside the chamber. Sections and modules, for forming the chamber, require a means of interconnection for structural integrity and sealed boundaries at the sites of connection. Sealed boundaries prevent escape of air and oxygen while allowing pressure inside the chamber to increase to the level needed for effective treatment. Typical design criteria require an HBO chamber to handle pressures of about 6 atmospheres absolute (ATA) with relative ease. Removable connectors such as nut and bolt combinations provide suitable means for assembling and disassembling chambers according to the current invention. Flexible seals, gaskets and fluid sealing materials, placed between modules and sections, prevent gas leakage and loss of pressure from a chamber. Before assembly, section and module manufacture produces parts small enough for easy portability. The parts are usually small enough to pass through a standard sized door frame allowing delivery for chamber assembly inside a building, without having to structurally modify the building. When needed, the modular chamber may be dismantled, moved and then conveniently re-assembled at a different location.

Exemplarily, a modular hyperbaric chamber for treatment of at least one patient, according to the present invention, includes at least one spacer module having a first flange and a second flange. The spacer module may be formed from a plurality of sections, with each section including opposing lip portions to form air-tight junctions. A first half cylinder module includes a first peripheral contact edge for releasable sealed connection to the first flange of the spacer module. Similarly, a second half cylinder module includes a second peripheral contact edge for releasable sealed connection to the second flange of the spacer module. An access door formed in at least one of the half cylinder modules provides access to the interior of the chamber.

In accordance with the foregoing, the invention is a variably sized, hyperbaric chamber, of modular construction, that is easily assembled at a medical treatment facility. The chamber is movable after dismantling. Apart from its modular construction, innovative features, according to the present invention, include the use of parts sized to pass through a standard doorway. Still further, temporary connections between parts for convenient assembly and disassembly and size adjustment is achieved by the addition of variably dimensioned stretch modules also referred to herein as spacer modules. A pressure lock, incorporated into a rectangular doorway enables entrance and egress by patients and support personnel.

The beneficial effects described above apply generally to the exemplary embodiments disclosed herein of the modular hyperbaric oxygen chamber. The specific structures through which these benefits are delivered will be described in detail hereinbelow.

BRIEF DESCRIPTION OF THE DRAWINGS

In the following, the invention will be described in greater detail by way of examples and with reference to the attached drawings, in which.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
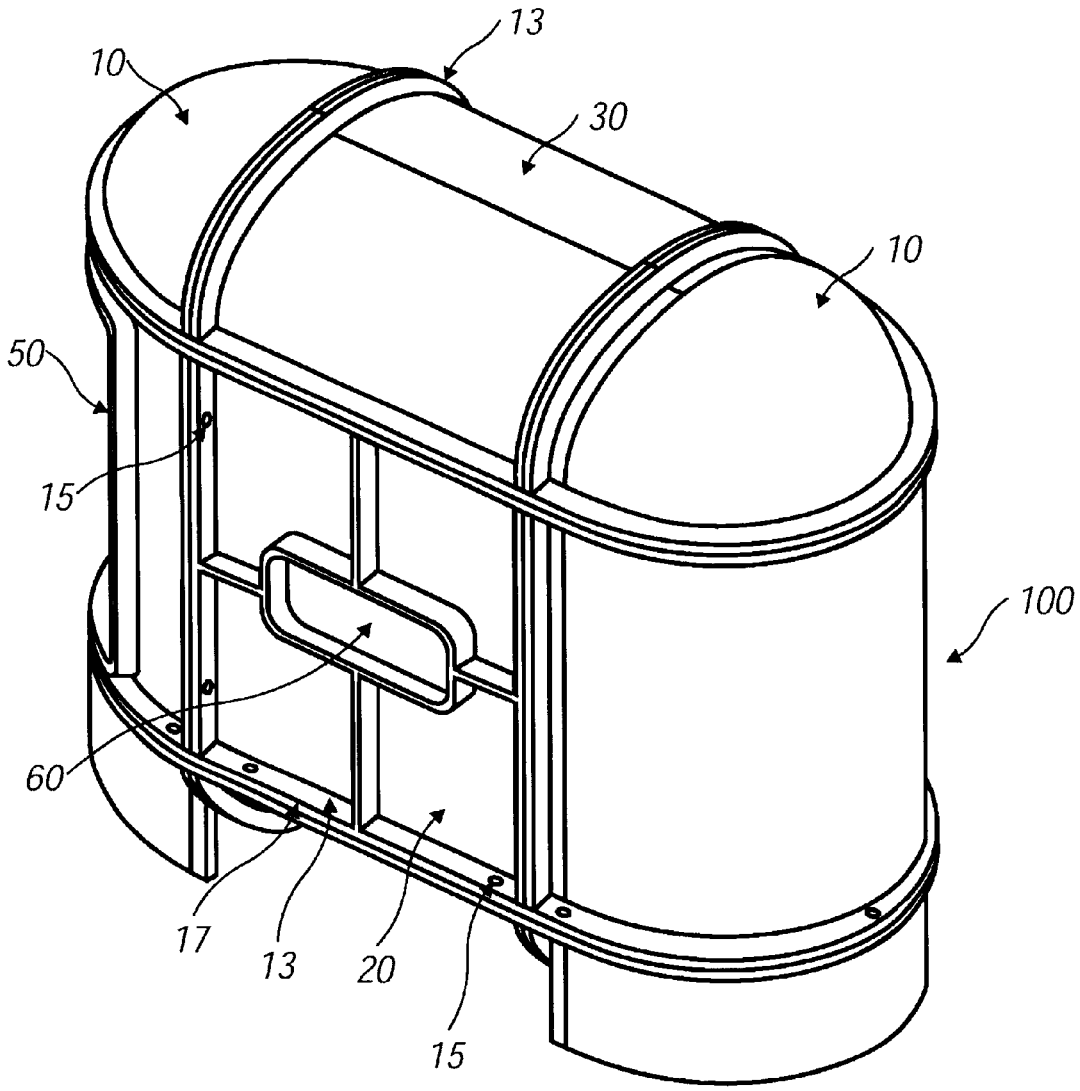
FIG. 1 is a perspective view of the modular HBO chamber according to the present invention depicting two opposing half cylinder modules connected to a spacer module and two rounded cover sections.

Referring to FIG. 1, the modular hyperbaric chamber 100, according to the present invention, includes two half cylinder modules 10. In effect, the two half cylinder modules 10 may be derived from the cylindrical portion of a typical monoplace chamber by dividing it lengthwise into two equal parts. Whereas the cylindrical portion of a monoplace chamber normally adopts a horizontal orientation, the half cylinders 10, placed in vertical orientation, may function as end modules, separated by a spacer module 18 as shown in FIG. 1. The spacer module 18 includes two side sections 20, a top section 30, and a bottom section 40. In preferred embodiments, the side sections 20 are generally flat panels, while the top 30 and bottom 40 sections may be either flat or rounded panels, with the latter producing the domed appearance of FIG. 1. The space representing the treatment room becomes totally enclosed by placement of rounded covers 12 at the upper and lower ends of the half cylinder modules 10. Contact edges 14 around the perimeters of the half cylinder modules 10 and flanges 22 around the spacer module 18 provide surfaces for releasable interconnection of the modules 10,18 using removable connectors including, but not limited to bolt 26 and nut combinations. Connections may be made, for example, using toggle bolts, interference connectors, edge gripping connectors and the like. Construction of the spacer module 18 from side 20 and top 30 and bottom 40 sections may use similar connectors inserted through lips 24 formed at either end of these sections 20,30,40. Rounded covers 12 may be securely attached to each end of the half cylinder modules 10 and top 30 and bottom 40 sections using the cover edges 16 around each of the four covers 12 used. Stability for the modular hyperbaric chamber 100, according to the invention, utilizes a support structure that may take a variety of forms including tables, frames, posts and the like. As shown in FIG. 1, support for the modular hyperbaric chamber 100 relies upon contact of an arcuate pedestal 17 at the lower end of each of the half cylinder modules 10. Contact between the pedestal 17 and a half cylinder module 10 may take the form of a supporting ledge on the inner face of the arcuate pedestal 17 or an alternative means, such as bolting 26, to provide more secure contact between the parts 10,17.

A reliable hyperbaric chamber 100 must be capable of withstanding a pressure of at least 3 atmospheres absolute (ATA). This requires that all seams associated with hyperbaric structures must be effectively sealed against gas leakage to maintain a desired pressure level. Therefore, as part of making all the connections, previously discussed, the flanges 22, lips 24 and edges 14,16 may be lined with a suitable seal, gasket or fluid sealant, for elimination of gaps between modules.

Figure 2:
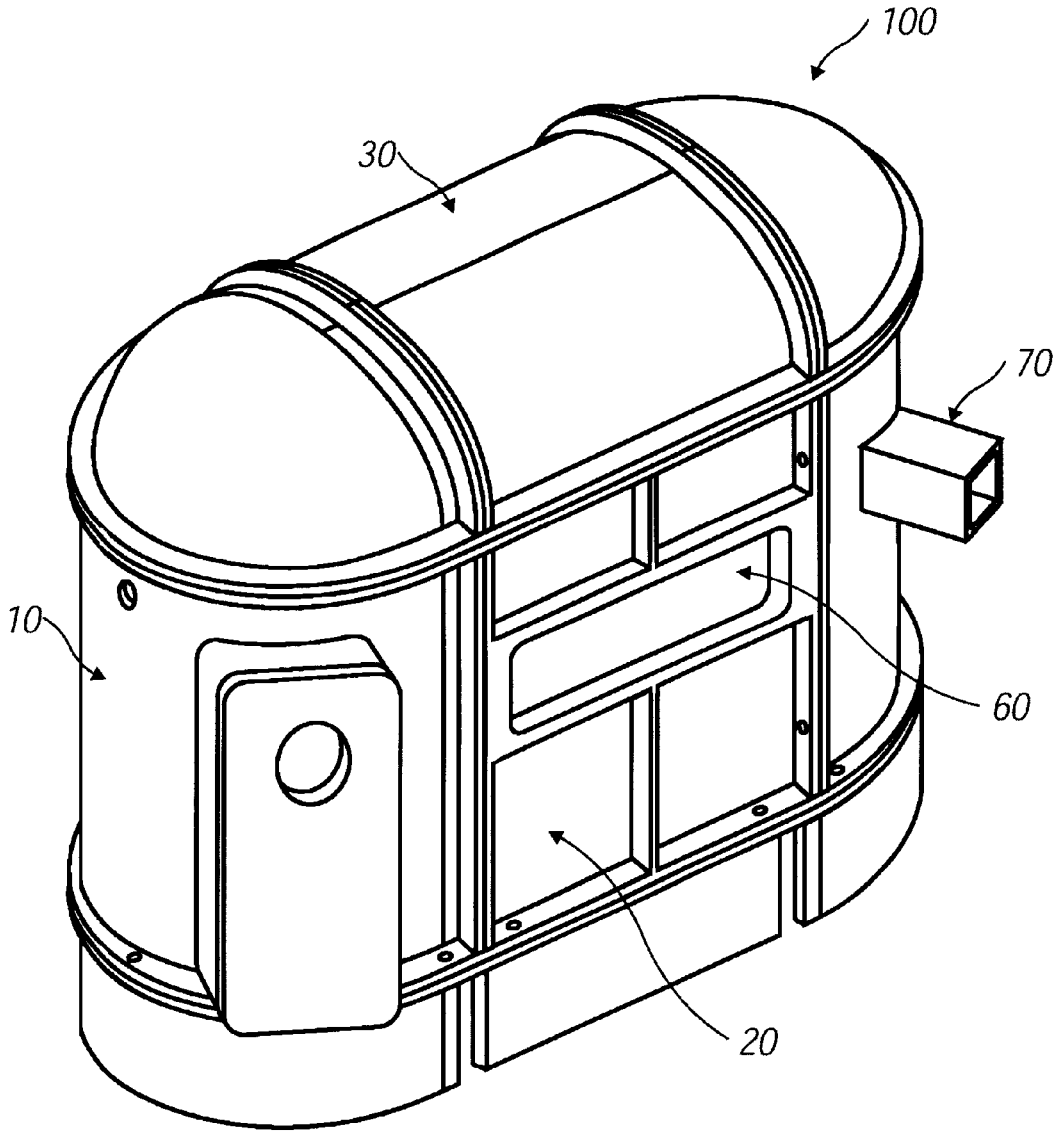
FIG. 2 is a perspective view of the modular HBO chamber according to the present invention showing a window for providing light, and an entry door and supply lock for access to the inside of the chamber.
Figure 3:
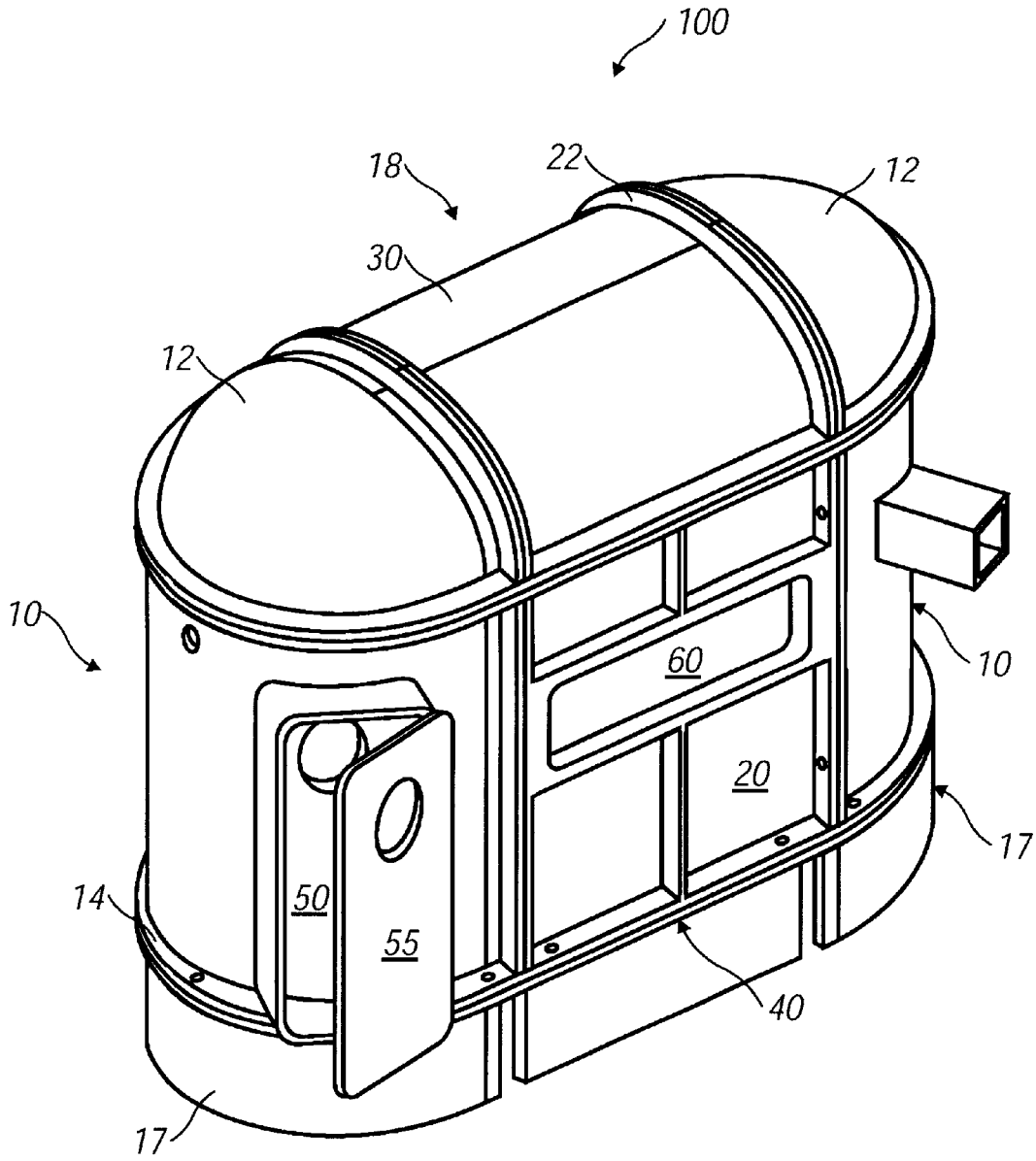
FIG. 3 is a perspective view of the modular HBO chamber according to the present invention taken towards the door side of the chamber.
Figure 4:
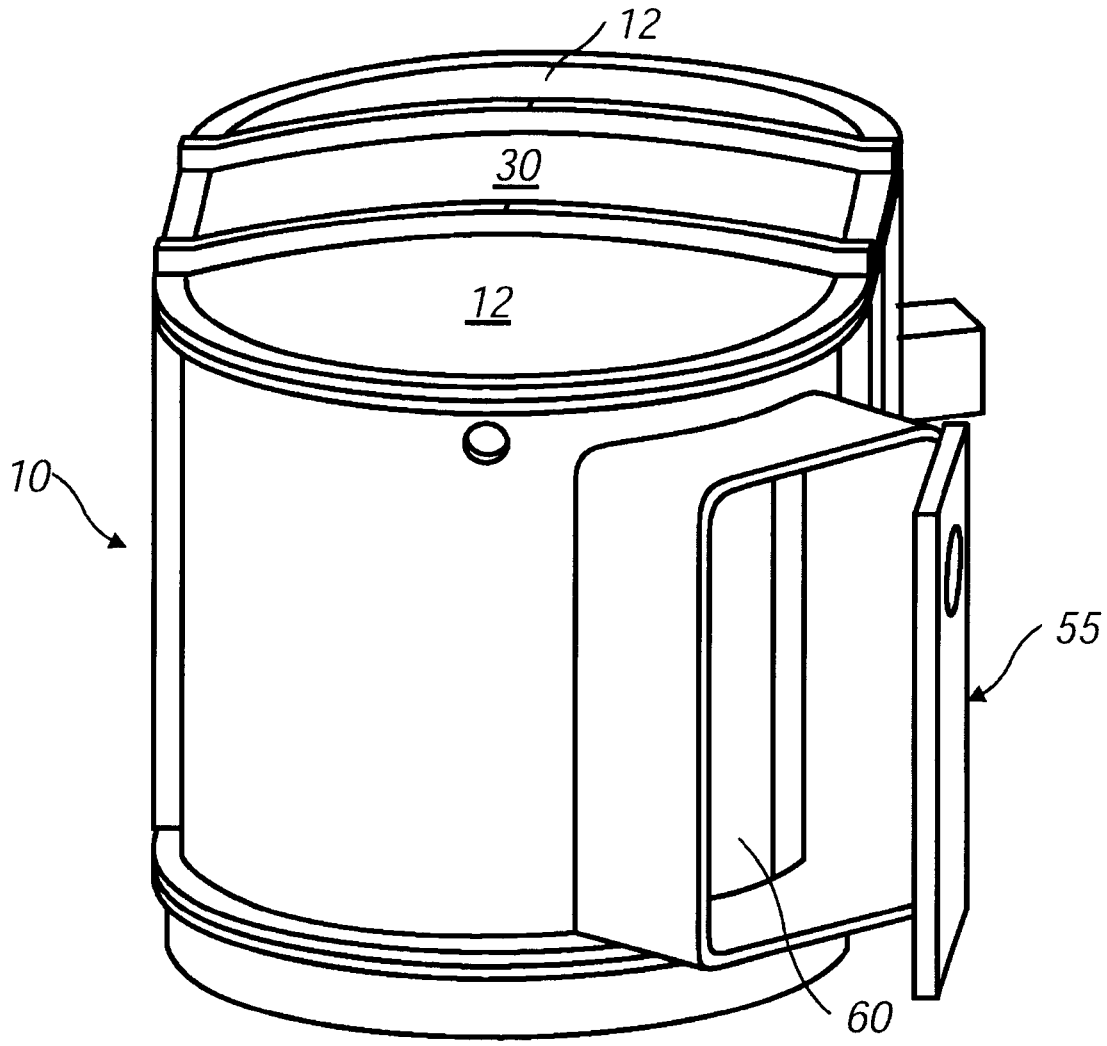
FIG. 4 is a side perspective view of the modular HBO chamber according to the present invention illustrating the door side of the chamber.

The description to this point has dealt with the enclosed space for the pedestal 17 supported hyperbaric chamber 100 as comprised of the half cylinder modules 10, the spacer module 18, and the rounded covers 12. The provision of a functional hyperbaric oxygen treatment facility requires additional features such as an access door 50, as well as optional features such as windows 60 in the side 20 or top sections 30, a supply lock 70 and a pressure lock as an alternative means of entry to the chamber 100. The structure may have other features for the supply of those utilities and services needed for the operation of the hyperbaric chamber 100. An access door 50, as illustrated in FIGS. 1 and 2, takes the form of a full-sized horizontally sliding door 50 capable of sliding along the curvature of the half cylindrical end 10, thereby allowing the entrance and exit of patients in wheel chairs and on litters. In one embodiment, an external door module 55 that is removably attachable to the half cylinder end module cooperates with a horizontally sliding door 50, described previously, to provide a pressure lock entry. This type of double door/pressure lock access allows movement in and out of the chamber 100 without loss of pressure. This feature allows convenient observation of a patient under treatment without confining the attendants within the chamber 100.

Side windows 60 or roof windows introduce a feeling of openness to the chamber 100 as well as reducing overall artificial lighting requirements. An appropriate window 60, as shown in FIGS. 1 and 2, provides light through at least one side section 20 of a spacer module 18 to allow the patient to look outside of the chamber 100. The window 60 must be sealed against pressure loss and withstand at least 3 ATA. Similar windows, positioned in a top section 30 of a hyperbaric chamber 100, bring in additional light and are also suitably rated to withstand at least 3 ATA. The supply lock 70 allows supplies, tools and equipment to pass in and out of the chamber 100. Rated to withstand at least 3 ATA, it is fitted in at least one of the half cylinder end modules 10 allowing convenient access for attendants to pass objects to and from the inner room during treatment of patients.

A preferred embodiment, representing the basic mini-multi hyperbaric chamber design, includes one spacer module 18 separating two half cylinder modules 10 with their ends closed by rounded covers 12, as depicted in FIG. 1. The modular structure may be manufactured from steel sections bolted together once inside a building. Since the modules 10,18 may be constructed from conveniently sized sections, a hyperbaric chamber 100, according to the present invention, can be brought into the building through a standard door eliminating the need for building modifications. Also, since it is bolted together, it can be disassembled and moved to another location and reassembled. The structure itself is about twelve feet long, slightly over seven feet wide with an interior height of at least seven feet. This design will accommodate approximately four ambulatory patients or one litter and one ambulatory patient and still provide space for an inside medical attendant. An innovative design feature requires installation of the interior door 50 to follow the curvature of the chamber wall so that it does not interfere with the useable interior space. The access door 50 size includes a height of about seven feet and a width of about three feet eight inches, to allow entry of a standard litter.

A unique capability of the present invention is the ease with which the chamber size may be increased by bolting additional spacer modules 18 between the half cylinder modules 10. Installation costs are minimized in that major building modifications are not necessary as they are for other multiplace designs. The basic system is designed to operate from existing medical air and oxygen supplies thus eliminating the need for an additional liquid oxygen supply or compressed air system. This allows the medical treatment facility to quickly add treatment space as the patient referral base grows. Though there is an upper limit to this expansion, it is possible to make an expanded chamber longer, by including more spacer modules, to accommodate a larger treatment load without having to acquire a completely new system. The basic or expanded mini-multi hyperbaric chamber is superior to monoplace hyperbaric chambers, currently available, for a variety of reasons. In its smallest configuration, the chamber 100, according to the present invention, will accommodate as few as one patient, but has space for more. The chamber 100 preferably uses compressed air for pressurization, instead of oxygen, thereby reducing any fire hazard. The innovative design provides a chamber 100 with more useable space than chambers having comparable exterior dimensions. This leads to enhancement of the patient's environment while giving support personnel more room in which to operate.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed and desired to be secured by Letters Patent is as follows:

1. A modular hyperbaric chamber for treatment of at least one patient, said hyperbaric chamber comprising:

at least one spacer module having a first flange and a second flange, said spacer module further comprising a plurality of sections, each of said plurality of sections including opposing lip portions to form air-tight junctions;

a first half cylinder module, including a first peripheral contact edge, having a releasable sealed connection to said first flange of said at least one spacer module;

a second half cylinder module, including a second peripheral contact edge, having a releasable sealed connection to said second flange of said at least one spacer module;

an access door formed in at least one of said first half cylinder module and said second half cylinder module; and a supply lock formed in at least one of said first half cylinder module and said second half cylinder module.

2. A modular hyperbaric chamber as recited in claim 1 wherein said plurality of sections includes a plurality of side sections, at least one top section and at least one bottom section.

3. A modular hyperbaric chamber as recited in claim 2 wherein at least one of said plurality of side sections has a window formed therein.

4. A modular hyperbaric chamber as recited in claim 3 wherein said at least one top section has a window formed therein.

5. A modular hyperbaric chamber as recited in claim 1, said half cylinder module further having opposing ends, wherein at least one end of said opposing ends is comprised of a rounded cover, said rounded cover having a cover edge engaging said contact edge of said half cylinder module and a said flange of said spacer module.

6. A modular hyperbaric chamber as recited in claim 1 wherein said releasable sealed connection further comprises a releasable fastening means allowing said hyperbaric chamber to be conveniently assembled and disassembled.

7. A modular hyperbaric chamber as recited in claim 6 wherein said fastening means is selected from the group consisting of bolted connections, interference connectors and gripping connectors.

8. A modular hyperbaric chamber as recited in claim 1, said chamber being formed using a rigid structural material.

9. A modular hyperbaric chamber as recited in claim 8, said structural material being steel.

10. A modular hyperbaric chamber as recited in claim 1 wherein said chamber is able to operate from existing gas supplies.

11. A modular hyperbaric chamber as recited in claim 10 wherein said gas is selected from the group consisting of air and oxygen.

12. A modular hyperbaric chamber as recited in claim 1, said chamber withstanding increased internal gas pressure.

13. A modular hyperbaric chamber as recited in claim 12 wherein said increased internal gas pressure is at least six (6) atmospheres absolute.

14. A modular hyperbaric chamber as recited in claim 12 wherein said increased internal pressure is at least three (3) atmospheres absolute.

15. A modular hyperbaric chamber as recited in claim 1 further comprising a support for said chamber.

16. A modular hyperbaric chamber as recited in claim 15 wherein said support is selected from the group consisting of tables, frames, posts and pedestals.

17. A modular hyperbaric chamber for treatment of at least one patient, said hyperbaric chamber comprising:

at least one spacer module having a first flange and a second flange, said spacer module further comprising a plurality of sections, each of said plurality of sections including opposing lip portions to form air-tight junctions;

a first half cylinder module, including a first peripheral contact edge, having a releasable seated connection to said first flange of said at least one spacer module;

a second half cylinder module, including a second peripheral contact edge, having a releasable sealed connection to said second flange of said at least one spacer nodule; and an access door formed in at least one of said first half cylinder module and said second half cylinder nodule, wherein said access door includes an external door module as a pressure lock to maintain a pressure differential between the inside and outside of said modular hyperbaric chamber.

* * * * *